US008806883B2

(12) United States Patent
Burk et al.

(10) Patent No.: US 8,806,883 B2
(45) Date of Patent: Aug. 19, 2014

(54) HEAT PUMP

(75) Inventors: Roland Burk, Stuttgart (DE); Michael Hess, Hirschhorn (DE)

(73) Assignee: Behr GmbH & Co. KG, Stuttgart (DE)

( * ) Notice: Subject to any disclaimer, the term of this patent is extended or adjusted under 35 U.S.C. 154(b) by 1833 days.

(21) Appl. No.: 12/097,152

(22) PCT Filed: Dec. 14, 2006

(86) PCT No.: PCT/EP2006/012058
§ 371 (c)(1),
(2), (4) Date: Jun. 12, 2008

(87) PCT Pub. No.: WO2007/068481
PCT Pub. Date: Jun. 21, 2007

(65) Prior Publication Data

US 2009/0000327 A1 Jan. 1, 2009

(30) Foreign Application Priority Data

Dec. 14, 2005 (DE) ..... 10 2005 060 183

(51) Int. Cl.
*F25B 13/00* (2006.01)

(52) U.S. Cl.
USPC ..... 62/324.6; 62/528

(58) Field of Classification Search
CPC ..... F25B 17/086; F25B 35/04; F25B 13/00; F28D 9/0043; F28F 9/0273
USPC ..... 62/324.6, 528, 498, 238.7, 476
See application file for complete search history.

(56) References Cited

U.S. PATENT DOCUMENTS 4,398,483 A 8/1983 Wood et al.
4,708,672 A 11/1987 Bentz et al.

(Continued)

FOREIGN PATENT DOCUMENTS

DE 195 15 527 A1 10/1996
DE 195 39 103 A1 4/1997

(Continued)

OTHER PUBLICATIONS

Smart Tabs raise your performance expectations, http://www.nauticusinc.com, 2 pages, website visited Aug. 24, 2010.

(Continued)

*Primary Examiner* — Mohammad M Ali
(74) *Attorney, Agent, or Firm* — Foley & Lardner LLP

(57) ABSTRACT

Heat pump comprising a number of hollow elements (2) with a first zone (2*a*), a second zone (2*b*) and a working medium which can be displaced in a reversible manner between the first and second zones, also comprising a number of plate elements (1) and a number of through-passage regions of a first type (4) arranged between the plate elements (1), further comprising a number of through-passage regions of a second type (5) arranged between the plate elements (1), and additionally comprising at least two distributing devices (7, 8) which are arranged at the ends of the plate elements (1) in each case, are provided for distributing a first fluid through the through-passage regions of the first type (4) and each have a fixed hollow cylinder and a distributor insert (7*a*, 8*a*) which can be rotated in the hollow cylinder, the distributor insert (7*a*, 8*a*) having partition walls (7*b*, 8*b*) which separate off at least four separate chambers (11) in each of the cylinders, and a flow path which comprises at least one through-passage region (4) being defined by way of each of the chambers (11).

31 Claims, 21 Drawing Sheets

(56) References Cited

U.S. PATENT DOCUMENTS

| | | | | | |
|---|---|---|---|---|---|
| 5,009,085 | A | * | 4/1991 | Ramshaw et al. | 62/476 |
| 5,020,411 | A | * | 6/1991 | Rowan | 89/1.11 |
| 5,085,603 | A | | 2/1992 | Haluzak | |
| 5,263,432 | A | | 11/1993 | Davis | |
| 5,275,014 | A | * | 1/1994 | Solomon | 62/324.1 |
| 5,421,173 | A | * | 6/1995 | Lee et al. | 62/485 |
| 5,507,672 | A | | 4/1996 | Imaeda | |
| 5,540,174 | A | | 7/1996 | Kishi et al. | |
| 5,683,275 | A | | 11/1997 | Nanami | |
| 5,685,253 | A | | 11/1997 | Alexander, Jr. | |
| 5,743,111 | A | * | 4/1998 | Sasaki et al. | 62/511 |
| 6,058,873 | A | | 5/2000 | Koyanagi | |
| 6,148,631 | A | * | 11/2000 | Watanabe et al. | 62/296 |
| 6,230,642 | B1 | | 5/2001 | McKenney et al. | |
| 6,332,422 | B1 | | 12/2001 | Laroche | |
| 6,524,146 | B2 | | 2/2003 | Spade et al. | |
| 6,604,479 | B2 | | 8/2003 | McKenney et al. | |
| 6,945,217 | B2 | * | 9/2005 | Makler | 123/241 |
| 7,174,726 | B2 | * | 2/2007 | Grau et al. | 62/115 |
| 7,305,928 | B2 | | 12/2007 | Bradley et al. | |
| 2003/0066638 | A1 | * | 4/2003 | Qu et al. | 165/186 |
| 2003/0221438 | A1 | * | 12/2003 | Rane et al. | 62/271 |

FOREIGN PATENT DOCUMENTS

| | | | |
|---|---|---|---|
| DE | 198 18 807 | A1 | 10/1999 |
| DE | 198 18 807 | B4 | 10/1999 |
| DE | 100 38 637 | A1 | 2/2001 |
| JP | 11-118286 | A | 4/1999 |
| JP | 11-294888 | A | 10/1999 |
| JP | 2004-340468 | A | 12/2004 |

OTHER PUBLICATIONS

Trim Tab Installation by James W. Hebert, http://continuouswave.com/whaler/reference, 17 pages, website visited Aug. 24, 2010.

Using an Accelerometer for Inclination Sensing, Analog Devices, http://search.analog.com/search/ProductSearch, 9 pages, website visited Aug. 24, 2010.

How Insta-Trim Boat Levelers Work, http://insta-trim.com, 9 pages, website visited Aug. 24, 2010.

Fiberglassing the Bottom Trailing Edge of a Power Boat, Boat Builder Newsletter #54, 1 page, http://www.glen-1.com/weblettr, website visited Aug. 24, 2010.

The Science of Levers, Tommy Boone, Ph.D., Mph et al., Chapter 51, faculty.css.edu/tboone2/asep/Lever.doc, 16 pages, website visited Aug. 24, 2010.

Porpoising oscillations of very-high-speed marine craft, Y. Ikeda and T. Katayama, The Royal Society, Phil. Trans. R. Soc. Lond. A (2000) 358, pp. 1905-1915.

* cited by examiner

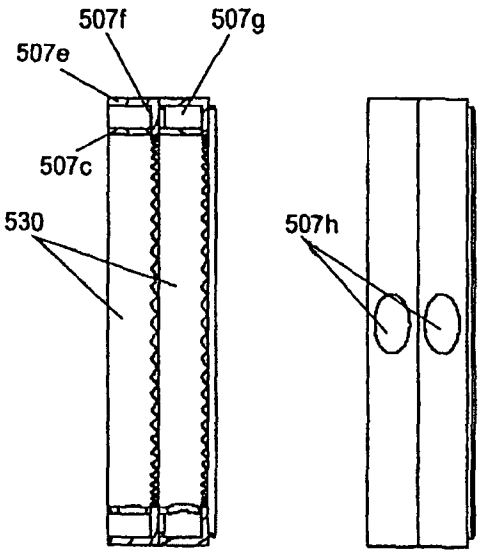
Fig. 22
Fig. 21
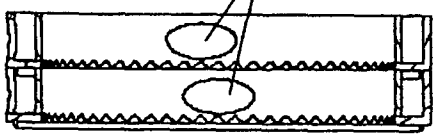
Fig. 23
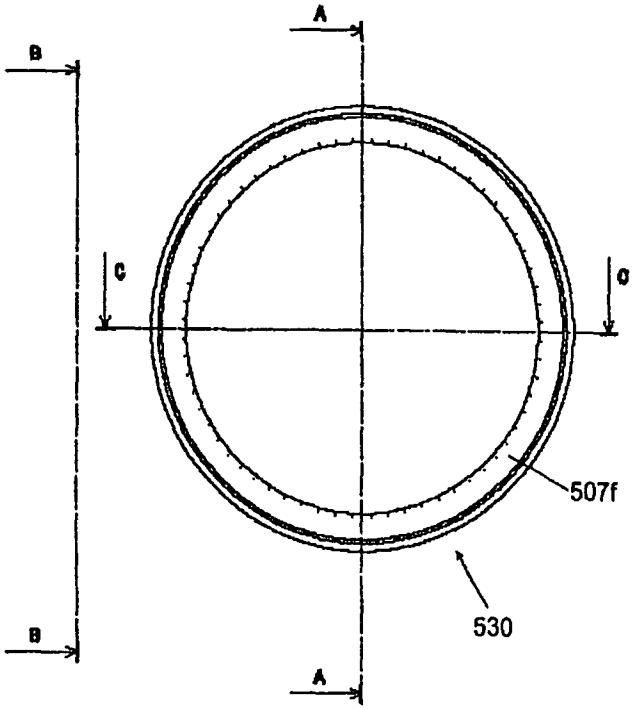
Fig. 20

HEAT PUMP

The present invention relates to a heat pump according to the preamble of claim 1.

DE 198 18 807 A1 describes a heat pump for air-conditioning vehicle passenger compartments that operates in accordance with the adsorber/desorber principle. In this vehicle air-conditioning system, a number of structured metal sheets are placed one on top of another in the form of a stack, so that they form closed cavities and passage spaces, an adsorber/desorber region and a condensation/evaporation region being formed in the cavities in each case. An air flow for heating and/or cooling down the adsorber region and an air flow for generating cooled air by flowing around the evaporator region are controlled in each case by a pair of distributing cylinders for the passage regions, the distributing cylinders having rotatable distributor inserts. The efficiency of a vehicle air-conditioning system of this type is not yet competitive in its described embodiment. In addition, the cooling power which can be achieved is limited in the case of the given overall size of the device.

The object of the invention is to improve the capacity and the driving heat requirement of a heat pump mentioned at the outset at a given overall space.

According to the invention, for a heat pump mentioned at the outset, this object is achieved by the characterizing features of claim 1.

The formation of in each case at least four separate helical chambers in each of the devices for distributing at least the first fluid allows significantly improved exchange of heat between the first fluid and the first zones of the hollow elements.

The term "a fluid" refers in the sense of the invention to basically any free-flowing substance, in particular a gas, a liquid, a mixture of the gaseous and liquid phase or a mixture of the liquid and solid phase (for example flow ice). The term "interaction of the working medium with the first and the second zone" refers to any type of a thermodynamically relevant exothermic or endothermic reaction of the working medium with or in the zone, in which, in particular, heat is exchanged between the respective zone and the fluid flowing around the zone. By way of a specific example, it should be noted that the first zone can contain an adsorber/desorber material, for example zeolite, wherein the working medium may be water which is, in particular, condensable or vaporable in the second zone in capillary structures. Alternatively, the zones can also contain, for example, differing metals, the working medium being for example hydrogen, so that metal hydrides are formed or dissolved in the zones, heat being absorbed and/or heat being emitted. The interaction of the working medium with the zones can include both physisorption and chemisorption or a different type of interaction. The term "a hollow element" refers in the sense of the invention to any element within which the working medium can be conveyed.

An example of the use of a heat pump according to the invention is building engineering. In building engineering, the heating power generated by a burner can be used also to raise environmental heat to a temperature level which can be used for heating purposes. Furthermore, the heat pump can be used, for example, in conjunction with a cogeneration unit to increase the overall efficiency. In winter the heat pump can, for example, be used for more effective utilization of the waste gas heat flow for heating purposes in that additional heat is pumped from outside-temperature level to a level which can be used for heating. In summer the same system, which may be slightly modified or else just set differently, can be used to cool the building in that the waste gas heat flow of the power generator is likewise used to drive the cooling means. Thermal solar energy can however also be used for cooling by means of the heat pump. Equally, the heat pump according to the invention can in principle also be used, as described in DE 198 18 807 A1, for the air-conditioning of, in particular, utility vehicles. Other conceivable applications include the use of district heat in summer for cooling or air-conditioning or the use of waste heat from industrial furnaces to generate air-conditioning cooling or process cooling. Generally, a heat pump according to the invention is distinguished by requiring very little maintenance and being highly reliable. There is high flexibility in the selection of the first and second fluid, which do not have to be the same and can, for example, differ for summer use and winter use.

In a preferred embodiment of the heat pump, the heat pump is an adsorption heat pump, the working medium being adsorbable and desorbable in the first zone and vaporable and condensable in the second zone. In an alternative preferred embodiment, the working medium is reversibly chemisorbable at least in the first zone. The heat pump may also be a pump based on a mixed principle, for example in the sense that some hollow elements operate in accordance with the adsorber principle (physisorption) and other hollow elements display chemisorption.

In a preferred development of a heat pump according to the invention, the flow paths include a first group of at least two adjacent flow paths and a second group of at least two adjacent flow paths, the flow paths of the first group all being flowed through in a first direction and the flow paths of the second group all being flowed through in a direction opposite thereto. This allows the individual flow paths of a group to be assigned to differing temperatures of the fluid, thus improving an exchange with the hollow elements at a given overall size or contact surface area of the fluid and hollow element as a result of adaptation to the temperature profile prevailing therein. An improvement is in this case achieved both by the same direction of the flow of fluid within one group and by the opposing directions of the two groups to each other, thus allowing for the inversion of the progression of temperature during emission of heat relative to absorption of heat.

In a preferred configuration, a plate element comprises a number of parallel flat tubes which are closed at their ends, each of the flat tubes forming a hollow element with a first and second zone. This allows a heat pump to be manufactured cost-effectively, the shape of the flat tubes benefiting an exchange of heat at a given overall size. Particularly advantageously, the flat tubes are hermetically separated from one another. This particularly allows differing hollow elements or flat tubes of the same plate element to display differing temperatures and pressures, leading, on appropriate grading of the temperatures in conjunction with a suitable direction of flow of the fluid along the plate elements, to an again improved exchange of heat at a given overall size.

Also preferably, a hollow plate, the cavity of which is associated with one of the passage regions, is arranged between two of the plate elements, the hollow plate being thermally connected in a planar manner to the adjacent plate elements, in particular connected by soldering. This facilitates a modular construction of a stack of plate elements and passage spaces in a simple and cost-effective manner, the number of specially produced complex components being kept low. Particularly preferably, arranged between two plate elements are in this case a hollow plate of a first type, forming a passage region of a first type, and a hollow plate of a second type which is substantially thermally separated from the hollow plate of the first type and forms a passage region of a second type. In this way, the two types of passage region are at the same time thermally separated while continuing to use standardized components. The hollow plates of the first and second type do not necessarily have to have the same thickness; this can be compensated for by appropriate formation of the plate elements or hollow elements; thus, for example, the hollow plate of the first type can be configured so as to be adapted for a liquid fluid and the hollow plate of the second type for a gaseous fluid.

Also preferably, at least two distributing devices which are arranged at the end of the plate elements in each case and associated with a distribution of the second fluid through the passage regions of the second type are each provided with a stationary hollow cylinder and a distributor insert which is able to rotate in the hollow cylinder. This allows distribution, which is optimized with regard to the exchange of heat, of the second fluid to the passage regions in a simple manner. Particularly preferably, the distributor insert of the devices for distributing the second fluid has in this case partitions which separate off at least three separate helical chambers in at least one of the cylinders, a flow path comprising at least one passage region of the second type being defined by each of the chambers. This also allows optimization of the exchange of heat of the second fluid with the second zones at a given overall space.

In a preferred embodiment, the partitions, which are in particular but not necessarily spirally formed, have lugs by means of which at least one flow path can be temporarily closed. Such temporary closure of a flow path with regard to the exchange of fluid can, depending on the formation of the heat pump, further improve the efficiency of an exchange of heat at a given overall size, by preventing bypass flows.

In a preferred formation of a heat pump, the distributor insert has a connection region with radial apertures, a fluid exchange of the chamber being carried out via the aperture which is aligned in each case with a chamber. This allows simple connection of the helical chamber to an outer fluid guide even when there are a large number of separate chambers. In a particularly simple formation, the fluid exchange of a plurality of the helical chambers is in this case carried out via a corresponding number of the apertures with a multipart connection space which at least partly surrounds the cylinder. Also preferably, a space of the first cylinder connected to a connection space of the second cylinder is connected via a number of channels which are separated from one another. Overall, this allows particularly complex guidance of a large number of flow paths using simple and cost-effective means.

Furthermore, provision may preferably be made for each of the distributor inserts to be able to rotate such that it can be driven in synchronization with the other distributor inserts. Phase-matched synchronization of the rotational movement of the distributor inserts is generally required for efficient functioning of the heat pump. Advantageously, the two distributor inserts of the first fluid and the two distributor inserts of the second fluid are each positioned in their phase position in such a way that the flow regions communicating with the chambers correspond to one another. In a preferred embodiment, a device for distributing the second fluid can in this case be altered relative to a device for distributing the first fluid such that it can be adjusted with respect to a phase position of a distribution cycle. This can be carried out, in particular, via a phase position of the distributor inserts. The adjustability of the phase position allows further optimization of the capacity of the heat pump. Generally speaking, optimization of the phase position can improve the mode of operation as a function of the average temperatures of the fluids, the type of mode of operation of the hollow elements and the type of working medium, the type of fluids and further parameters of the heat pump.

In a further advantageous formation, an inclination of a coiled chamber is not constant over the length of the cylinder. As a result, a variable number of passage regions are connected to each chamber over a cycle or a revolution of the distributor insert or the flow path defined by the chamber has a variable width; in individual cases, this can optimize the capacity of the heat pump at a given overall space.

Generally speaking, a plurality of hollow elements which are hermetically separated from one another may be provided, at least two of the hollow elements having differing working media and/or sorbents. In principle, a heat pump according to the invention is not limited to uniform substance systems in each of the hollow elements.

In order generally to improve heat exchange performance, provision is preferably made for the flow paths of the first fluid to be flowed through in the opposite direction compared to the flow paths, which are associated via identical hollow elements, of the second fluid.

In a first expedient design, provision is made for the partitions of the distributor insert to be spirally formed and for the separated-off chambers to be helical.

In an alternative expedient embodiment, the partitions of the distributor insert run substantially straight over the length of the distributor insert. In this way, the distributor inserts can be manufactured simply and cost-effectively, in particular as bodies, at least certain portions of which are substantially prismatic. These bodies can be manufactured, for example, as optionally post-machined extruded profiles. For simple provision of the plurality of flow paths, the hollow cylinder has in this case a plurality of apertures, apertures which succeed one another in the axial direction each being arranged offset from one another by an angle. This provides in a constructionally simple manner a cyclic sequence of flow paths which migrate in the stacking direction of the hollow elements as a result of rotation of the straight distributor insert.

In a particularly suitable constructional detailed solution, the hollow cylinder surrounding the distributor inserts has in this case an inner and an outer wall, a plurality of annular chambers arranged in axial succession being formed between the two walls. This allows, in particular, simple connection of the hollow cylinder to the stack of plate elements or hollow elements. Particularly preferably, the annular chambers are formed as annular chamber modules which can be stacked in the axial direction. This allows manufacture, which is adapted in a cost-effective manner, of hollow cylinders or distributing devices of differing lengths or heat pumps of differing size to be achieved using the same parts.

In a further advantageous embodiment of the heat pump, a means is provided for distributing the second fluid to optimize capacity at a given overall space, the second fluid being guided by means of the distributing device via a plurality of flow paths through the passage regions of the second type. Particularly preferably, one of the flow paths forms in this case a closed loop which is separated from the remaining flow paths of the second fluid. The closed flow path has in this case advantageously a smaller width in the stacking direction than an adjacent flow path, the closed flow path being guided, in particular, for intermediate-temperature evaporation and/or intermediate-temperature condensation. Such guidance of the closed flow path forms inner thermal coupling of an evaporation zone and a condensation zone of the heat pump, thus allowing, in particular, heat sources to be utilized even at a lower temperature range. In an expedient detailed configuration, the closed flow path comprises in this case a pump member for conveying the fluid.

This embodiment utilizes the possibility of producing merely by means of the fluid control a type of cascade connection, either to lower the required desorption temperature and/or to increase the difference in temperature between the minimum adsorption temperature and evaporation temperature (rise in temperature). This is achieved as a result of the fact that the fluid distributing cylinders for fluid-controlling the phase alternation zone contains between the distributing chambers for condensation and for evaporation intermediate chambers through which an additional small circuit circulates. As a result, heat is transferred from the condensation end phase to the evaporation end phase using cold fluid to cool the condenser. This causes a reduction in pressure at the end of the desorption/condensation phase, thus lowering the temperature required for complete desorption. The rise in pressure associated therewith at the end of the adsorption/evaporation phase raises the required adsorption temperature. These effects can also serve to increase the effectively utilized load width of the adsorbent or reactant used.

Further advantages and features of the invention will emerge from the exemplary embodiment described hereinafter and also from the dependent claims.

A preferred exemplary embodiment of a heat pump with a plurality of modifications will be described hereinafter and explained in greater detail with reference to the appended drawings, in which:

FIG. 20 is a plan view onto the annular chamber modules from FIG. 19, from the front in the axial direction;

FIG. 21 is a sectional view through the annular chamber modules from FIG. 20 taken along the sectional line A-A;

FIG. 22 is a plan view onto the annular chamber modules from FIG. 20 taken along the line B-B;

FIG. 23 is a sectional view through the annular chamber modules from FIG. 20 taken along the sectional line C-C;

Figure 1:
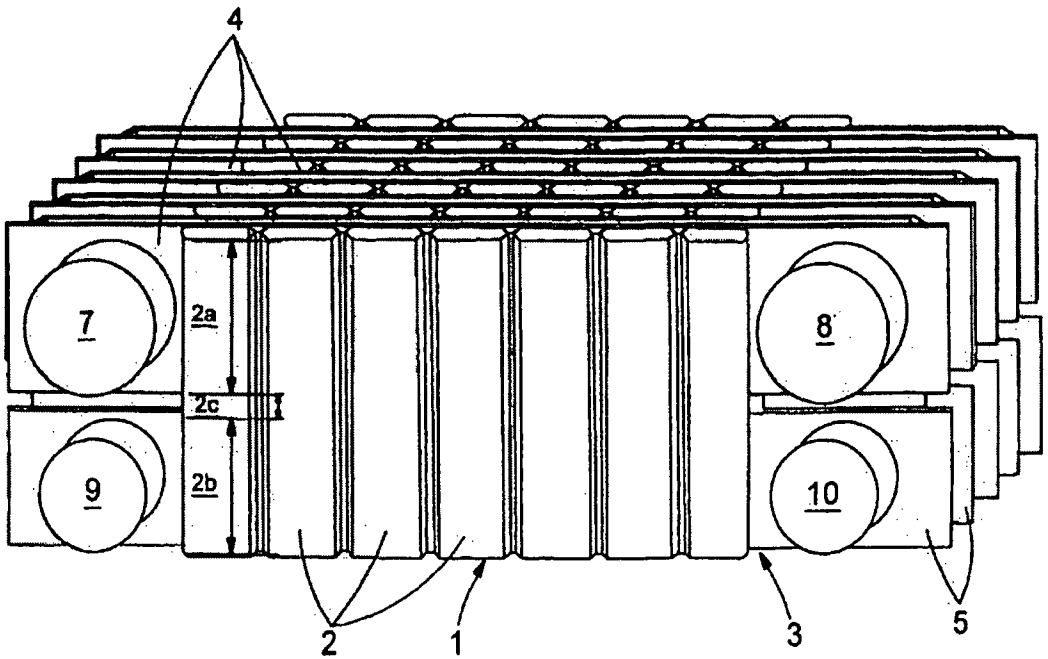
FIG. 1 is a schematic three-dimensional view of a first embodiment of a heat pump according to the invention.

heat pump from FIG. 1 is constructed in the form of a stack from alternating layers. In this case, a first type of layers is formed from plate elements 1 comprising in the present case a total of seven adjacent flat tubes 2 which are closed at their ends.

The flat tubes are integrally connected to one another but hermetically separated from one another. Each of the flat tubes 2 forms a hermetically closed hollow element or a continuous cavity which has a first zone 2*a* and a second zone 2*b*. The flat tubes are closed at both end faces.

Provided between the two zones 2*a*, 2*b* is an empty interval 2*c* which causes a certain spacing of the zones 2*a*, 2*b*. A respective adsorbent medium, in particular zeolite, which is in optimum thermal contact with the outer wall of the flat tube 2, is provided in the first zone 2*a*. The second zone 2*b* is lined on its inside with a suitable capillary structure allowing optimally effective storage of a liquid phase of a working medium, in particular water, provided in the flat tube 2. The zone 2*a* thus forms an adsorber/desorber zone and the zone 2*b* forms an evaporator/condenser zone. With regard to the precise configuration of the zones, reference is made, in particular, to the disclosure of document DE 198 18 807 A1. In an alternative preferred embodiment, the adsorbent medium is activated carbon and the working medium water. Irrespective of the aforementioned pairs of adsorbent medium and working medium, in terms of design, all of the exemplary embodiments describe adsorption heat pumps. As mentioned at the outset, the invention is not limited to this operating principle but may rather include all other processes or reactions of a working medium.

Figure 2:
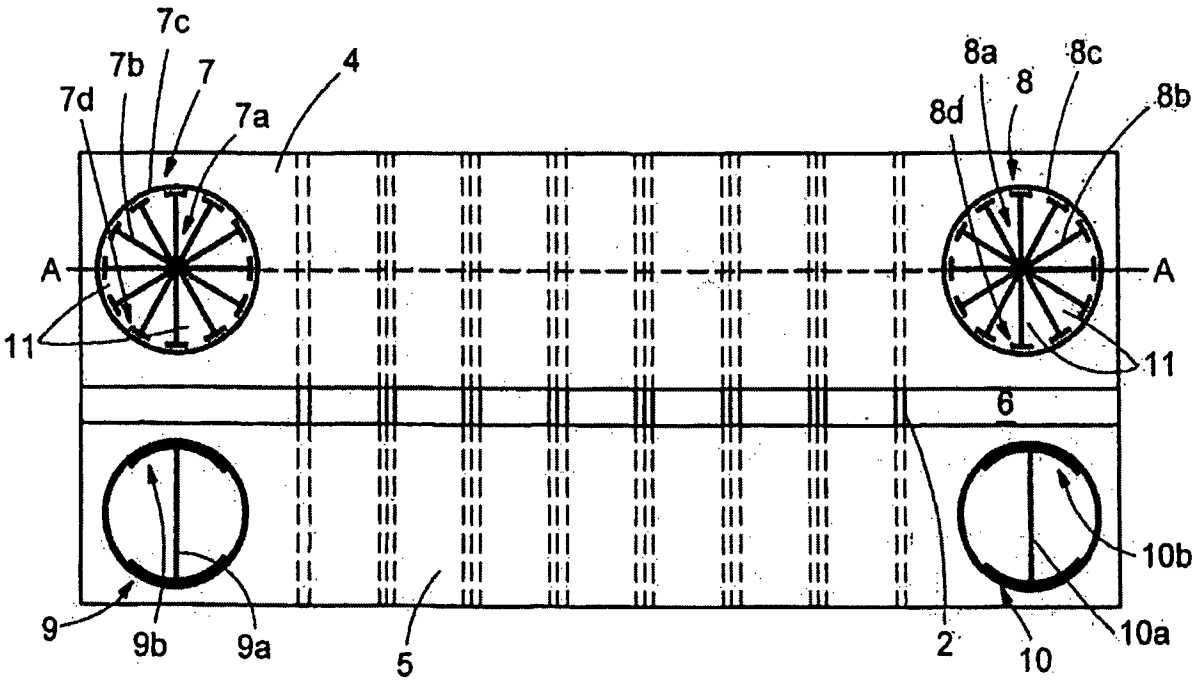
FIG. 2 is a schematic sectional view through the heat pump from FIG. 1, the sectional plane running in a plate element.
Figure 3:
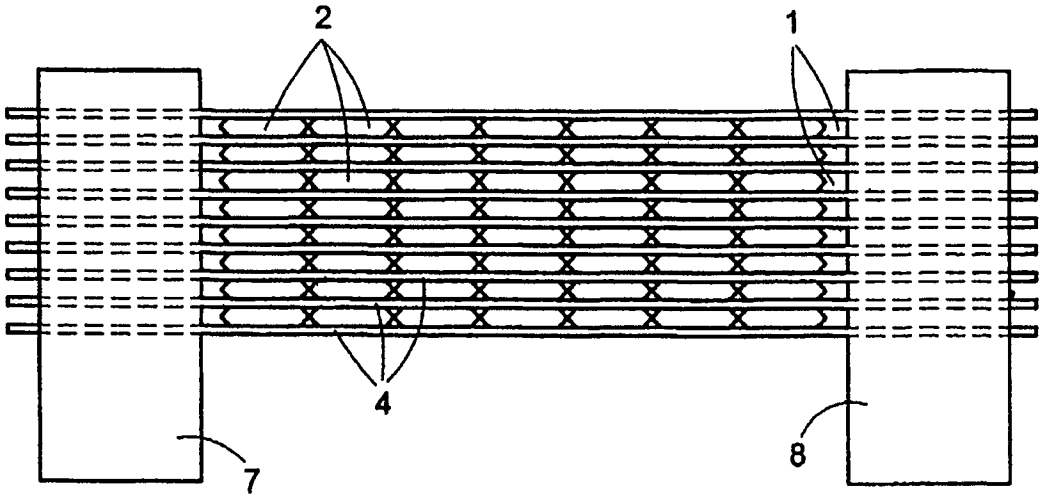
FIG. 3 is a schematic sectional view of the heat pump from FIG. 2, the sectional plane running along the line A' A.

A respective layer 3, within which a passage of a first fluid and a second fluid is provided, is located between two plate elements 1. In this case, the first fluid is thermally connected to the first zones 2*a* and the second fluid to the second zones 2*b* of the plate elements 1 while passing through the layers 3. The layer 3 comprises a first type of hollow plates 4 and a second type of hollow plates 5. These hollow plates are also closed at their ends and on their upper and lower longitudinal sides. The hollow plates 4, 5 are soldered, bonded or braced in a planar manner to the respectively adjacent plate elements 1 to ensure effective thermal contact. Located between two hollow plates 4, 5 of the same layer is a gap 6 which substantially prevents thermal contact between the hollow plates 4, 5. The sectional view according to FIG. 2 is a cross section in the plane of the hollow plates 4, 5, the boundaries of the cavities 2 of the plate elements 1 being indicated as broken lines. The hollow plates 4 and 5 can contain inner structures, ribs, turbulence inserts and the like (not shown in the present document) to improve the transfer of heat of the fluid flowing therethrough to the surfaces in contact with the plate elements 1.

Distributing devices 7, 8, 9, 10, each having substantially the shape of a cylinder, are provided perpendicularly to the planes of the plate elements 1 and the hollow plates 4, 5 in end-side regions of the hollow plates 4, 5. A first cylinder 7 and a second cylinder 8 are in this case provided in opposing end regions of the first hollow plates 4 and a third cylinder 9 and a fourth cylinder 10 are provided in opposing end-side regions of the hollow plates 5. In this case, the first two cylinders 7, 8 serve to distribute a first fluid through passage regions of a first type formed in the hollow plates 4 and the pair of cylinders 9, 10 serves to control or distribute the flow of a second fluid through the hollow plates 5 and the passage regions thereof.

Each of the cylinders 7, 8, 9, 10 has a rotatable distributor insert 7*a*, 8*a*, 9*a*, 10*a* which is guided in a cylindrical inner circumference of a stationary hollow cylinder. The first distributor insert 7*a* and the second distributor insert 8*a* are substantially the same in their design. Each of the distributor inserts 7*a*, 8*a*, by means of which a through-flow of the first fluid is controlled, comprises a number of helical chambers 11 which are formed by spirally formed partitions 7*b*, 8*b* and the inner circumferential walls 7*c* and 8*c* of the cylinders 7, 8. Respective lugs 7*d*, 8*d*, which cover part of the cylindrical inner circumferential wall 7*c*, are attached to the partitions 7*b*, 8*b*, radially to the ends thereof.

Figure 4:
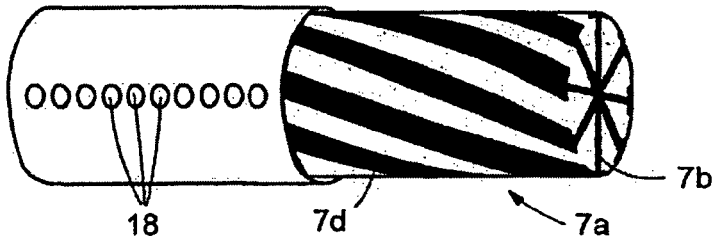
FIG. 4 is a schematic three-dimensional view of a part of a cylindrical distributing device of the heat pump from FIG. 1 with the insert extracted.
Figure 5:
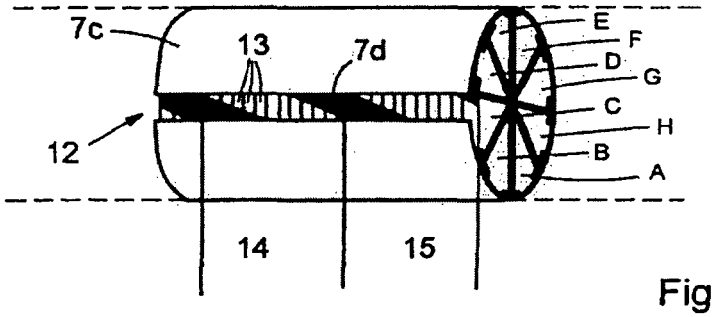
FIG. 5 is a schematic three-dimensional view of a detail of the distributing cylinder from FIG. 4.
Figure 6:
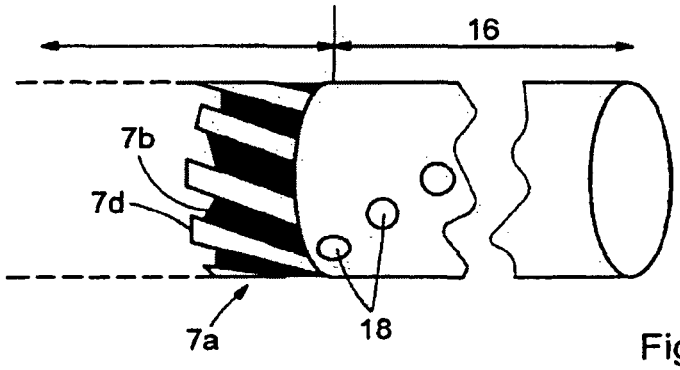
FIG. 6 is a three-dimensional view of the end portion of the cylinder from FIG. 4.

The three-dimensional views according to FIG. 4 to FIG. 6 of the cylindrical distributing device 7 illustrate the functioning thereof. It will be noted that in the drawings the precise number of helical chambers 11 varies; thus, for example, FIG. 2 shows 12 chambers and FIG. 4 to FIG. 6 just eight chambers in each case. In FIG. 5 these eight chambers are denoted by letters A to H. FIG. 5 shows, in particular, a slotted opening region 12 in the cylindrical wall 7*c*, through which the fluid enters the passage regions 13 of the hollow plates 4. A number of passage regions 13 are in this case each at the same time connected to a chamber 11 of the distributor insert 7*a*. FIG. 5 illustrates a first flow path 14 thus formed and a second flow path 15 which are each at the same time connected to a plurality of passage regions 13 or hollow plates 4. The flow path 14 is in the present case connected to the chamber B and the flow path 15 to the chamber C. As may be seen, as a result of their spiraling covering of certain portions of the inner circumferential wall 7*c*, the lugs 7*d* prevent any of the passage regions 13 from being connected to more than one flow path 14, 15 or more than one individual chamber A-H.

The distributor inserts 7*a* are expediently formed in such a way that their coiled chambers 11 or spirally formed partitions 7*b* rotate, over the length of the distributor insert 7*a* and the height of the stack of plates 1, 4, 5 of the heat pump, fully about the axis of symmetry of the cylinder.

Figure 7:
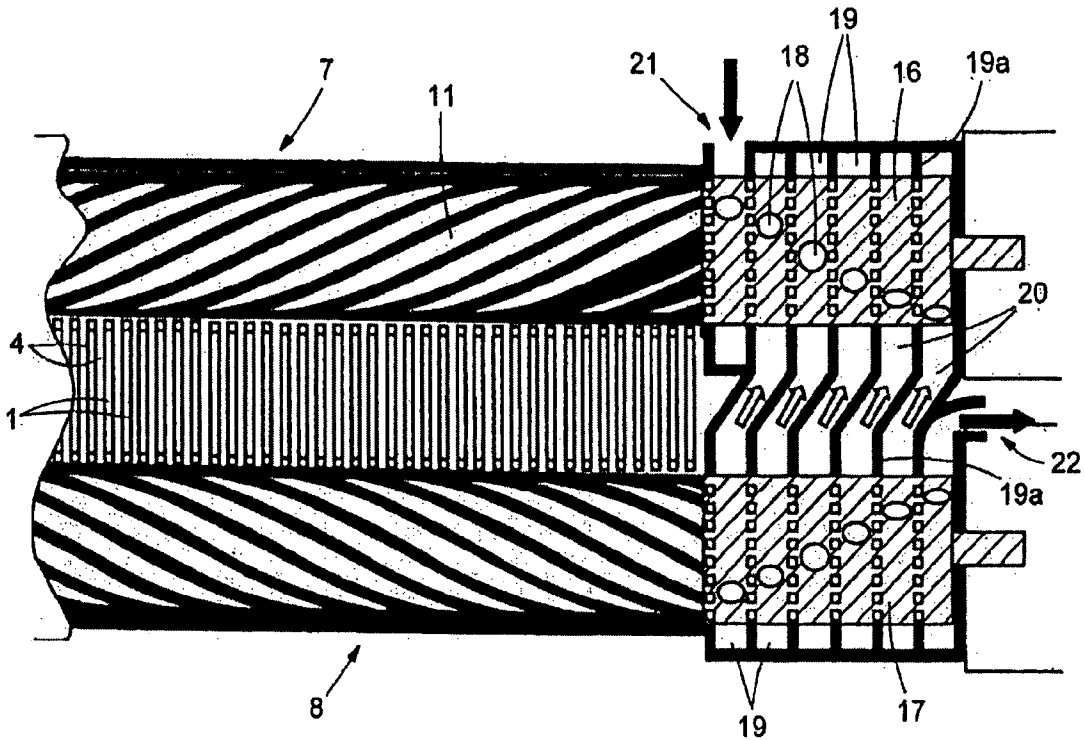
FIG. 7 is a schematized sectional view through a heat pump according to FIG. 1 to illustrate the course of flow paths.

As a result of driven rotation of the distributor inserts 7*a*, 8*a* within the stationary hollow cylinders 7*c*, 8*c*, the group of the passage regions 13, each of which is connected to the same chamber 11, thus migrates along a stacking direction of the plates 1, 4, 5 of the heat pump. This is illustrated, in particular, by the schematic view in FIG. 7. The heat pump from FIG. 7 has distributor inserts 7*a*, 8*a* with a plurality of chambers, in the present case 12 chambers, in accordance with the view from FIG. 2. The distributing devices 7, 8 have at at least one end region of the distributor inserts 7*a* and 8*a* connection regions 16, 17 allowing outer connection of the individual chambers 11 of the distributor inserts. For this purpose, the connection regions 16, 17 comprise a closed outer surface of the end regions of the distributor inserts 7*a*, 8*a* with a number of radially directed apertures 18 which are arranged in isolation and offset from one another and are each connected to one of the chambers. The schematic view according to FIG. 7 shows merely connection regions for 6 chambers.

Connection spaces 19 surrounding the connection regions 16, 17 are provided outside the connection regions 16, 17. The spaces 19 are separated from one another by means of annular partitions 19*a* which rest on the closed regions of the surfaces of the connection regions 16, 17 so as to produce a sliding seal, in particular in the manner of shaft ring seals. As a result, in each case just one aperture 18 is connected to one of the annular connection spaces 19, the annular spaces 19 being isolated from one another.

A number of connecting channels 20 (shown merely schematically in FIG. 7), which each connect one annular space of the first distributing device 7 to one annular space of the second distributing device 8, are provided for connecting the annular spaces 19 in a controlled manner. Some of the annular spaces 19 also have connections 21, 22 via which external heat exchangers can be connected to the heat pump, such as is illustrated schematically in FIG. 8. In this case, according to FIG. 8, a heating device 23 is arranged between two annular spaces 19 of the first distributing device 7 and an ambient air cooler 24 with a fan 25 is arranged between two annular spaces 19 of the second distributing device 8. In addition, a pump 26 is provided before the cooler 24 for circulating the first fluid.

Figure 8:
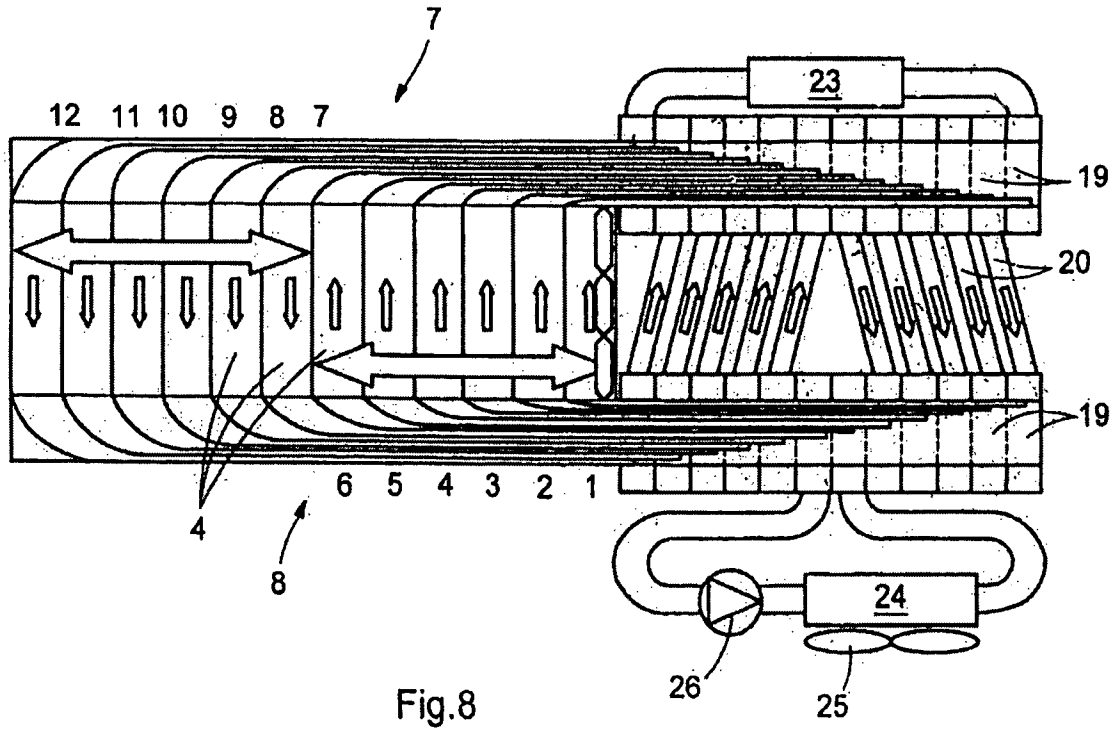
FIG. 8 is a schematized view of the heat pump from FIG. 7, flow paths of differing temperature being shown in differing shades of grey.

FIG. 8 illustrates, in particular, the connection of the individual flow paths also with regard to the direction of flow thereof between the plate elements 1. Shown symbolically are three adjacent cavities 2 of a plate elements 1, the axes of which extend perpendicularly to the plane of the drawing and around which the first heat-carrier fluid flows (in the direction indicated by the arrow). Overall, the heat pump according to FIG. 8 has twelve separate flow paths, so each of the distributing devices 7, 8 has twelve respective helical chambers. The twelve flow paths in the region of the exchanger are numbered continuously in FIG. 8 by Arabic numerals 1-12. In this case, the first six flow paths 1-6 form a first group of flow paths and the flow paths 7-12 form a second group of flow paths. The groups are indicated by double-headed arrows. All of the flow paths within one of the two groups are each adjacent and directed in the same direction, as indicated by the small perpendicular arrows in the region of the hollow plates. The direction of flow of the second group runs in this case in the opposite direction to the direction of flow of the first group. In the drawing of FIG. 8 the temperatures of the first fluid in the individual flow paths are illustrated by differing shades of grey. The sequence of the temperatures of the numbered flow paths from cold to hot is thus 6-5-4-3-2-1-7-8-9-10-11-12. Between the respectively adjacent flow paths of the two groups, which are the flow paths 6 and 7 on the one hand and also 1 and 12 on the other hand, there is in each case a relatively large jump in temperature, whereas the other changes in temperature between adjacent flow paths are relatively small. In particular, as a result of this division in combination with the displacement described hereinafter of the through-flow paths and the external wiring to a heater 23 and a recooler 24, particularly high efficiency is achieved at a given overall size of the heat pump. This results from stepped absorption of perceptible heat from plate elements 1 to be cooled of a first group of flow regions (right-hand double-headed arrow in FIG. 8) for preheating plate elements 1 to be heated of a second group of flow regions (left-hand double-headed arrow in FIG. 8).

Synchronous rotation of the two distributor inserts 7*a*, 8*a* then causes displacement of the flow paths in accordance with the varying connections of the helical chambers 11 to the passage regions 13 in the stacking direction of the plate elements 1 or the hollow elements 4. This variation in the contacting of the individual chambers 11 with the individual passage regions 13 is equivalent to migration of the flow paths in the stacking direction, in the present case toward the right. As a result of the displacement of the flow paths toward the right, the sorption tubes 2, which are illustrated by way of example, are gradually cooled down more and more until the coldest zone has reached these elements. A large proportion of the adsorption heat transferred in this process is in this case transferred to the heat-carrier fluid which is heated more and more in the process. The heating power of the subsequent heating element 23 can be reduced as a result. In principle, the flow paths migrate or the distributor inserts rotate very slowly, as these processes are adapted to the sluggishness of the exchange of heat between the first fluid and the respective hollow elements 2 and also of the conveyance of substances within the hollow elements 2.

In the exemplary embodiment according to FIG. 8, the first fluid is a thermal oil ("Marlotherm") which is in the liquid phase. In principle, the first fluid can also be gaseous, although in particular in embodiments with a large number of separate flow paths the first fluid is preferably a liquid.

The first group of flow paths (flow paths 1-6), which are in addition the first six flow paths after the cooling in the cooling element 24, serve to cool down the first zones or the sorption regions of the cavities 2, whereas the second six flow paths serve to heat up these regions.

Figure 9:
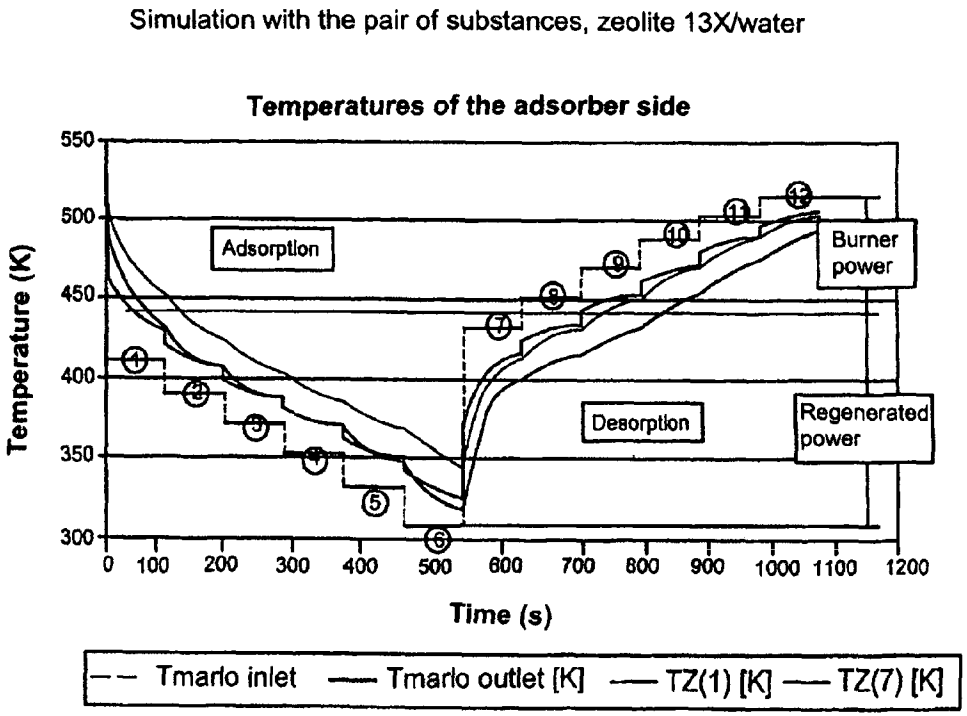
FIG. 9 is a diagram of a march of temperature over time on an adsorber side of the heat pump.

FIG. 9 shows corresponding marches of the temperatures over time over a cycle of various measuring points of the plate element 1 illustrated in FIG. 8 by way of example with the three sorption tubes 2. These are the fluid inlet temperature (Tmarlo inlet), the fluid outlet temperature (Tmarlo outlet), the zeolite temperature on the inlet-side sorption tube or cavity 2 of a plate element 1 (TZ(1)) and the zeolite temperature of an outlet-side sorption tube (TZ(7)) of the, in total, 7 flat cavities 2 arranged adjacent to one another, only 3 of which are shown in FIG. 8. It should be borne in mind that there is both spatial and temporal periodicity over the flow paths of the heat pump. As the diagram of FIG. 9 shows, at the limits of the two groups of flow paths there is in each case a relatively large change in temperature of the first zones 2*a* of the cavities 2 in a short time, caused by the jump in temperature of the adjoining flow paths of the two different groups of flow paths. At these points, the cooling phase adjoins the heating phase (or zone) and vice versa.

Figure 10:
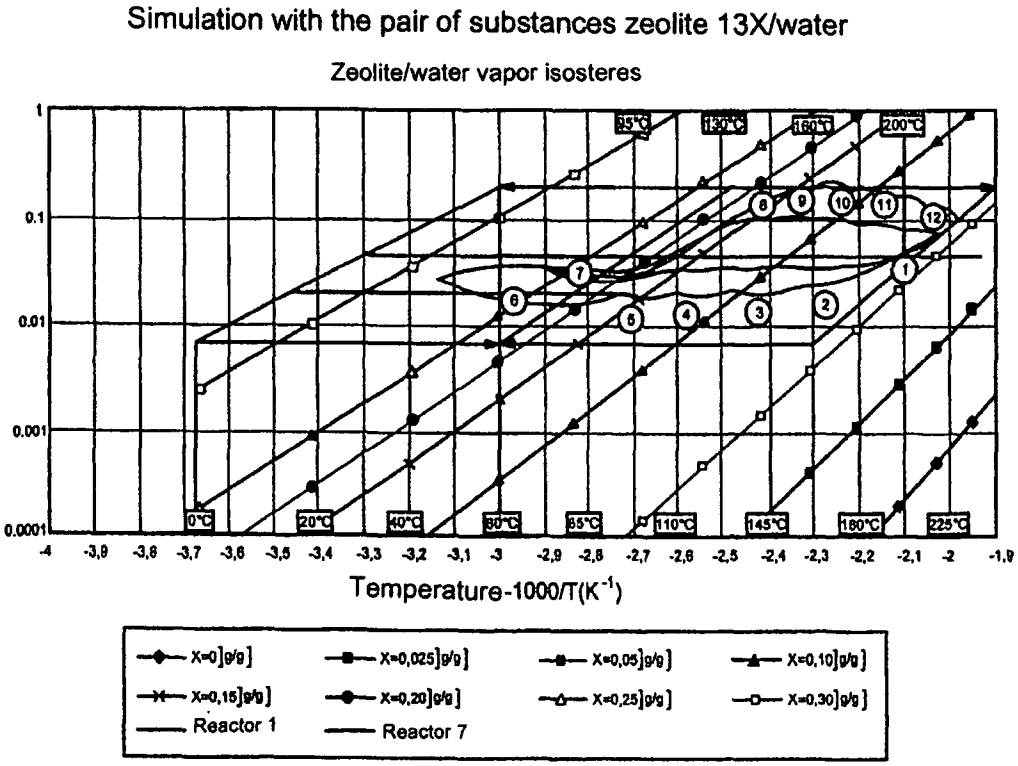
FIG. 10 is a diagram of a cyclic process of two different cavities of a plate element of the heat pump from FIG. 1.

To further illustrate the cyclic processes in the sorption region of the heat pump, FIG. 10 shows a diagram in which a water vapor partial pressure in logarithmic scale is plotted over the temperature in negative inverse scale. The diagonal lines are what are known as isosteres, i.e. lines of constant equilibrium loading of the exemplary pair of working substances, zeolite 13×/water. Plotted are cyclic processes of an inlet side cavity (reactor 1) and an outlet side cavity (reactor 7) of a specific plate element 1 of the heat pump.

Figure 11:
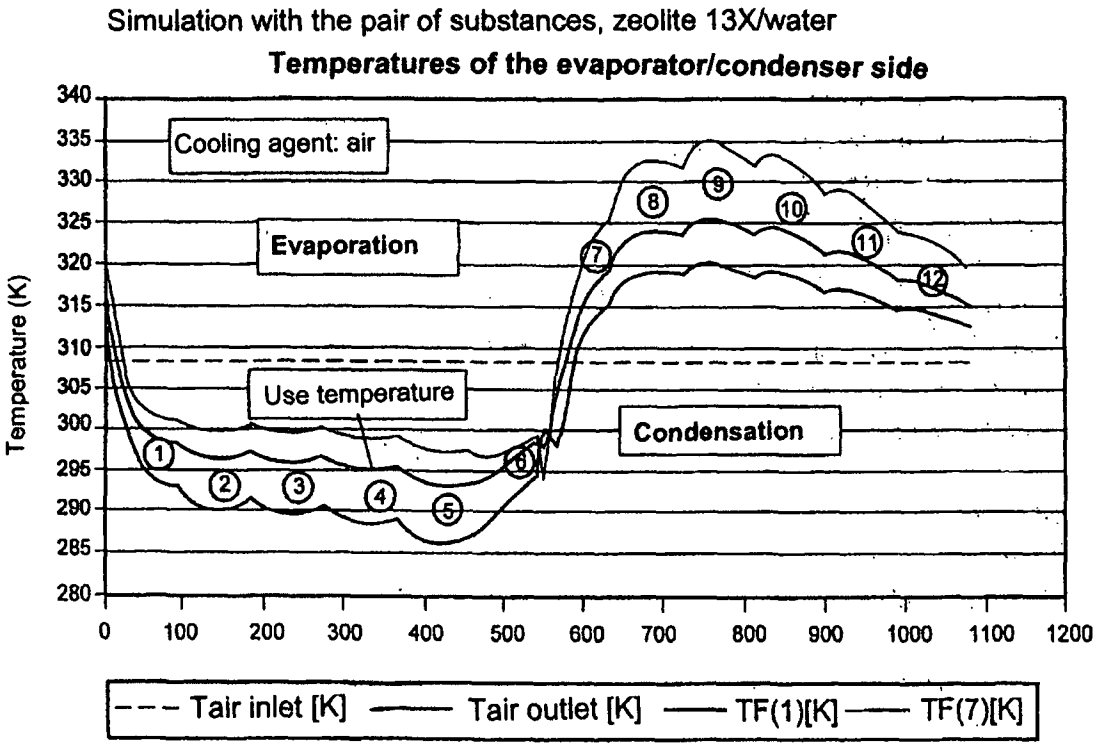
FIG. 11 shows the march of temperature over time of two different cavities of a plate element on an evaporation/condensation side of the heat pump from FIG. 1.

A third diagram according to FIG. 11 shows for the example from FIG. 8 how the temperature in the region of the second zone, i.e. the evaporator/condenser side, behaves. The second fluid is in the present case air. As the march of temperature over time according to FIG. 11 demonstrates, there are substantially two levels of temperature in the distribution in space and time over the plate elements 1 of the heat pump.

As shown in FIG. 2, the distributor inserts 9*a*, 10*a* of the devices 9, 10 for distributing the second fluid flowing through the second zone are each divided into just two helical chambers 11. As a result, for many cases, the heat pump ensures sufficient differentiation of the flow paths of the second fluid through the heat pump. The invention then operates, taking into account the illustrations according to FIG. 8 to FIG. 11, as follows:

At the starting point in time, a selected sorption plate (cavity 2) is at the highest temperature. In the view according to FIG. 8, this is the last sorption plate in the flow direction or the last cavity 2 of the flow path "1". The plate element has in this case a total of seven cohesive cavities 2, of which the schematized view according to FIG. 8 indicates just three cavities.

As a result of slow further rotation of the distributor inserts 7*a*, 8*a*, all twelve flow paths, each of which have a differing temperature, migrate toward the right, as a result of which the cavity first enters into contact with increasingly cool first fluid. As a result of adsorption of working medium, in the present case water vapor, the pressure in the cavities 2 falls (see FIG. 10) and in the second zones of the cavities 2 water evaporates, as a result of which this side is cooled down (see FIG. 11). As a result, heat is continuously withdrawn from the second fluid, in the present case air, as it flows past the second zone of the cavity 2.

After passing through the coldest zone, zone No. 6 according to FIG. 8, which immediately follows the cooler 24 and corresponds substantially to ambient temperature (in the present case 30° Celsius), the sorbent in the cavity 2 has reached its maximum loading and the heating and desorption phases subsequently commence.

In the present example, the fluid temperature jumps rapidly to approximately 160° C., corresponding to the point of transition from flow path No. 6 to flow path No. 7. As a result, the sorbent is heated rapidly. After passing through equilibrium loading, the adsorption changes into desorption, as a result of which the water vapor partial pressure rises rapidly (see FIG. 10), so in the second zone the evaporation changes into condensation (see FIG. 11). During this partial process, the working medium, water, migrates, driven by the gradual increase in temperature within a cavity 2, continuously from the adsorption medium (first zone) to the condensation zone (second zone), where it is held by a heat pipe-like capillary structure (not shown in greater detail) and homogeneously distributed, for the purposes of effective thermal contact, on the wall of the second zone of the cavity 2.

It is in this case advantageous to orient the heat pump in the space in such a way that the axes of the cavities 2 lie substantially horizontally in order to prevent adverse influences of gravity on the distribution of the working medium.

Both the adsorption/evaporation process (useful process) and the desorption/condensation process (regeneration process) are timed, by adapting the rotational speed of the distributor inserts, in such a way that use is made of a loading region of the adsorbent that leads to a good compromise between power density and the ratio of useful heat to drive heat of the device as a whole. In the present simulated example, both partial processes are of equal length. Asymmetrical division in terms of time of the two partial processes is however easily possible in that the chambers 11 of the distributor inserts 7*a*, 8*a* are distributed accordingly asymmetrically along the circumference. This can expediently be achieved by adapting the division of the opening angles for the chamber segments.

Likewise, it can be beneficial, to optimize the mode of operation, to set a phase shift between the control of the distributing devices 7, 8 for the adsorption/desorption zone and the distributing devices 9, 10 for the evaporation/condensation zone. FIG. 9 and FIG. 11 reveal that the change-over from evaporation to condensation lags behind the change-over between adsorption and desorption as a result of thermal inertia. A defined, in particular adjustable, phase shift can help in this regard.

Figure 12:
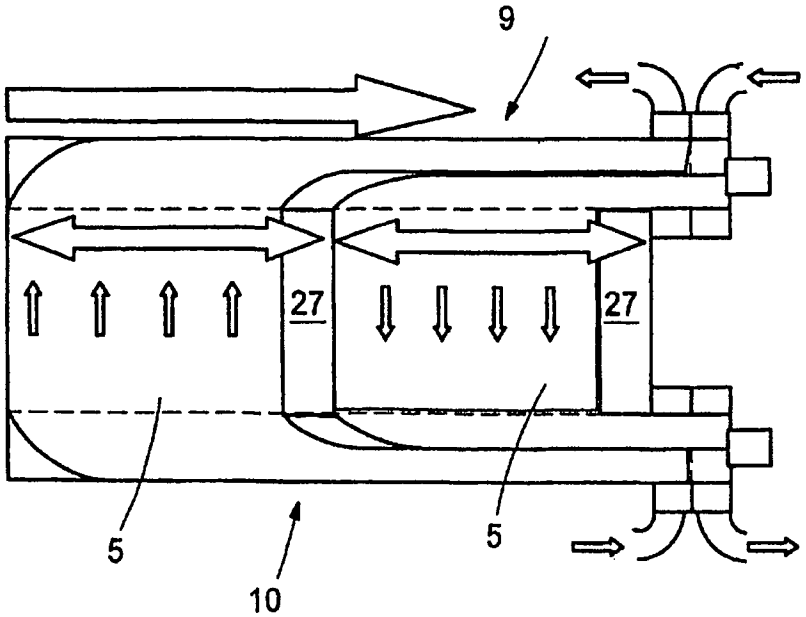
FIG. 12 is a schematic view of the second passage regions in accordance with the view from FIG. 8 of a first modification of the heat pump.

In a first modification of the above-described heat pump, what are known as adiabatic phases can be introduced. This is provided in the view according to FIG. 12, which corresponds to the view according to FIG. 8, by isolated flow paths 27 or isolation of in each case one or more passage regions from the through-flow of fluid. The view relates to the guidance of the second fluid within the evaporation/condensation zone. This provides improved isolation of the adjacent flow paths of the zone to be cooled down for condensation and the zone to be heated up for evaporation, thus reducing the temperature flux, which is particularly disadvantageous at this point owing to the jump in temperature, between adjacent flow paths. To achieve such adiabatic phases 27, the lugs 9*b*, 10*b* of the corresponding chambers 11 of the distributor inserts 7*a*, 7*b* are shaped in a simple manner so as to be particularly large. As a result, these specially shaped lugs cover one or more of the passage regions located between the flow paths for evaporation and condensation, so no fluid is conveyed in these passage regions. FIG. 12 shows the position, corresponding to FIG. 8, of the flow paths in the evaporation/condensation zone. It is crucial in this regard that the directions of flow of the second fluid in FIG. 12 are also directed in the opposite direction to the directions of flow of the first fluid in FIG. 8 and are also directed in opposite directions to one another.

As mentioned hereinbefore, the focus of the development of a heat pump according to the invention is on the control of the adsorption/desorption process or the processes of the first zones and the corresponding control of the second fluid in the second zone. However, owing to the slight differences in temperature, with the exception of adiabatic zones, usually fewer chambers of the distributor inserts, and thus fewer differing flow paths, are required in the second zone controlling the evaporation/condensation process. In the simulated example described hereinbefore, there is therefore only one group of flow paths for evaporation and one for condensation, such as is in principle known from DE 198 18 807 A1. However, to improve the heat pump, provision may be made also in this region for multiple through-flow which takes place in accordance with the division of the chambers 11 of the distributor inserts 9*a*, 10*a*. In this case, individual chamber segments can be used as deflecting segments, distributing and collecting segments.

Figure 13:
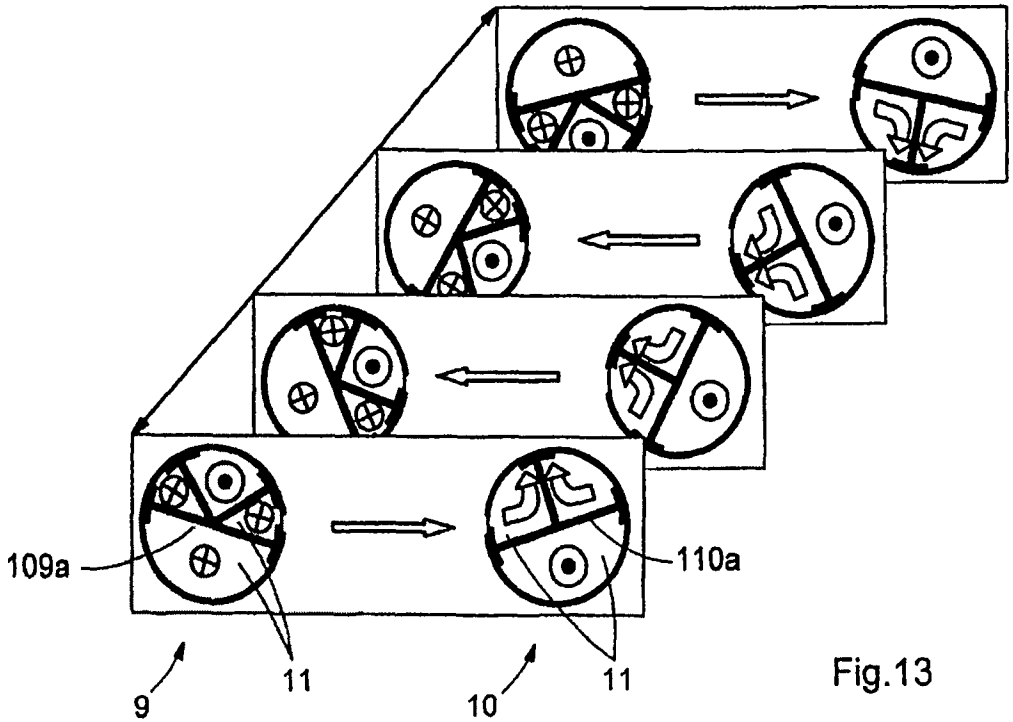
FIG. 13 is a schematic view of a fluid distribution of the second passage regions of a second modification of the heat pump.

By way of example, FIG. 13 shows an arrangement in which the two distributing devices 9, 10 have differingly shaped distributor inserts 109*a*, 110*a*. As a result, a somewhat lower use temperature can be achieved, depending on the substance system used.

The view according to FIG. 13 shows four sections in differing planes along the stacking direction of the heat pump.

The first distributor insert 109*a* has, viewed in cross section, a chamber having an opening angle of 180°, two chambers which symmetrically adjoin said chamber and have an opening angle of 45°, and a chamber which is arranged therebetween and has an opening angle of 90°. The other distributor insert 110*a* has a chamber having an opening angle of 180° and two chambers having an opening angle of 90°. Directions of flow of the fluid are in each case indicated by means of an arrow tip as coming out of the plane of the drawing and by means of an arrow shaft (cross) as going into the plane of the drawing.

The second fluid to be cooled is guided into the two 45° chambers of the left-hand distributor insert and enters the first and the last of the partial blocks shown from the left-hand side in each case. On the opposing side, they are received by the two 90° chambers of the distributor insert 110*a* and distributed to the two central partial blocks which are then flowed through in the opposing direction. In a further configuration, the partition between the two 90° chambers may be dispensed with to allow mixing of the two partial flows out of the end-side partial blocks. The two 180° chambers are provided for the condensation zones.

Figure 14:
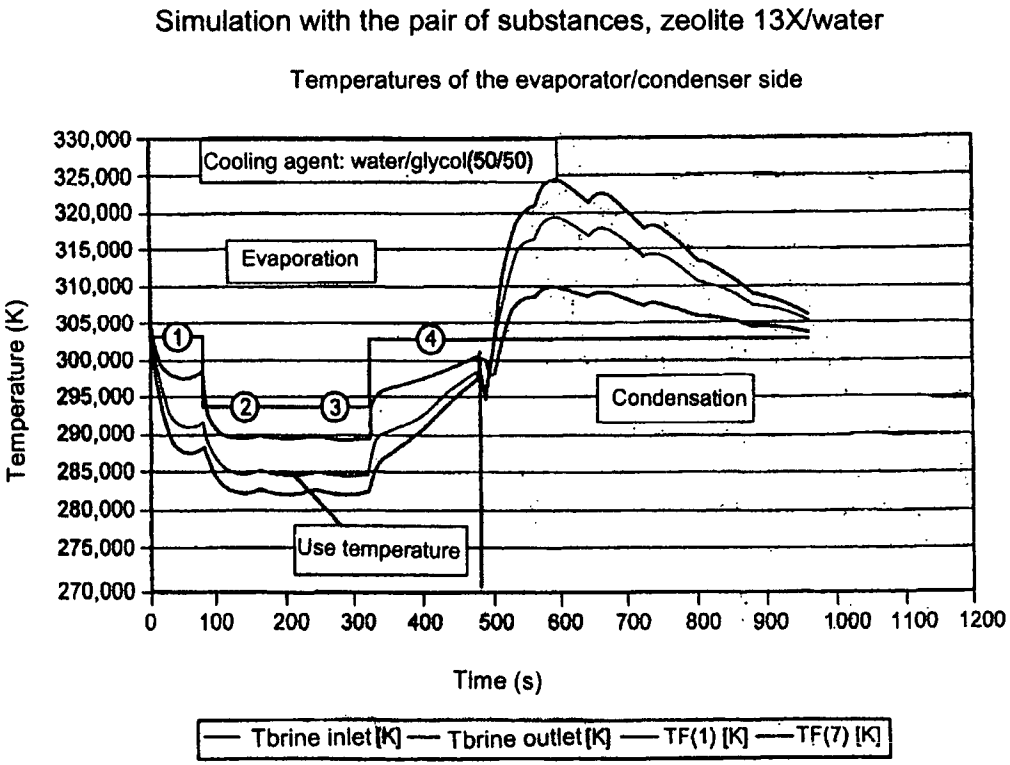
FIG. 14 is a diagram as in FIG. 11, based on the modification according to FIG. 13.

The diagram according to FIG. 14 shows the result of the modification according to FIG. 13, the second fluid used being a water/glycol mixture. As may be seen, a lower use temperature of 285° Kelvin, which accordingly is applied only in a shorter time range, has been facilitated. The introduction, proposed according to FIG. 12, of adiabatic zones would provide a further improvement, although this has not been taken into account in the simulation according to FIG. 14.

Figure 15:
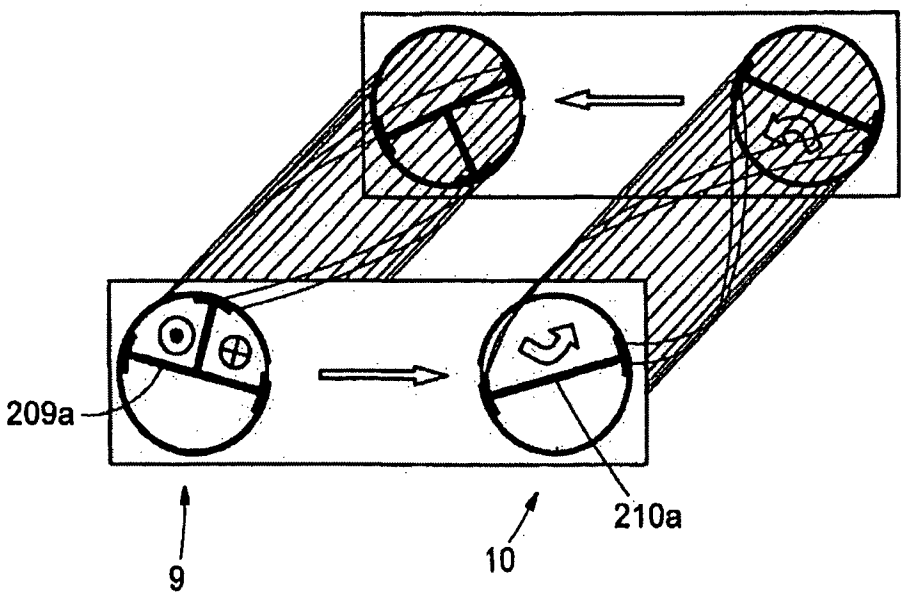
FIG. 15 shows a modification of the heat pump from FIG. 13.

Alternatively, the flow path, provided for evaporation, of the second zone can also be flowed through twice with only two partial blocks. An exemplary division of chambers to implement such a modification is shown in FIG. 15. In this case, the first distributor insert 209*a* has two 90° chambers and one 180° chamber, the second distributor insert 210*a* comprising just two coiled 180° chambers.

Figure 25:
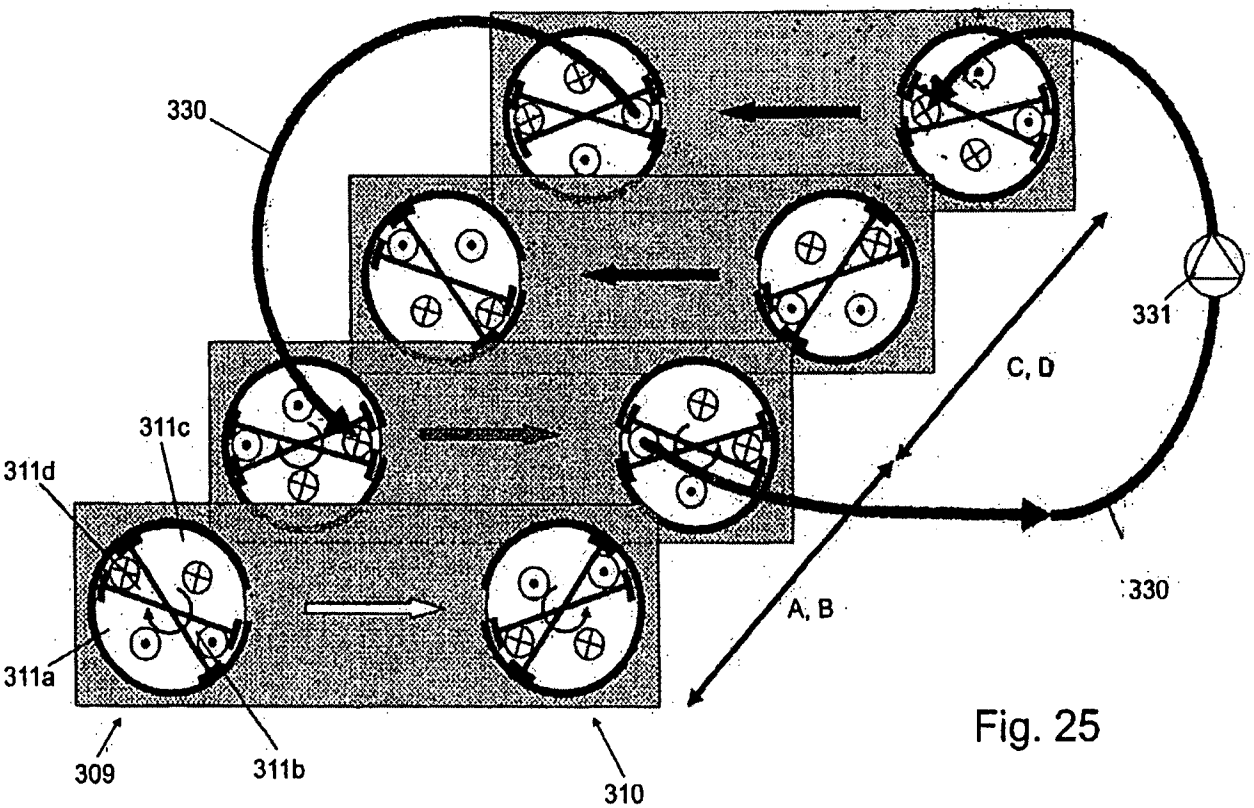
FIG. 25 is a schematic view of a fluid distribution of the second passage regions of a further exemplary embodiment of the heat pump, an additional closed flow path of the second fluid being present.
Figure 26:
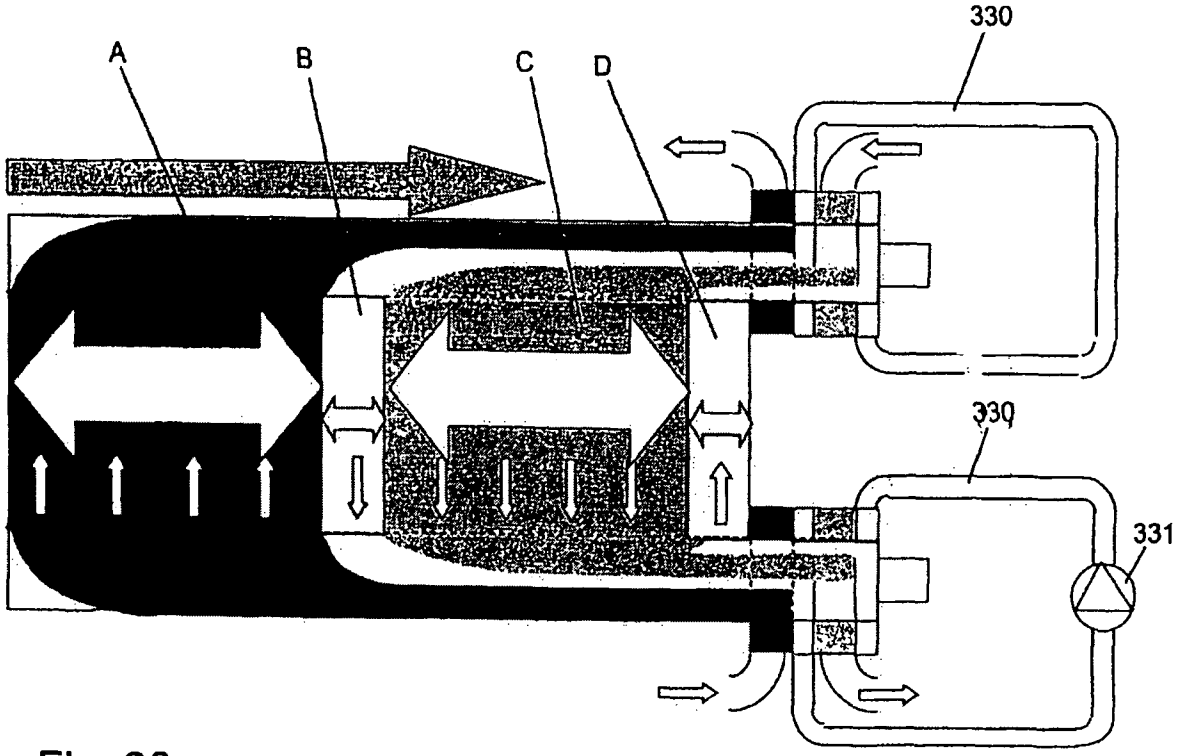
FIG. 26 is a schematic view of the flow paths of the second fluid of a heat pump according to FIG. 25.
Figure 27:
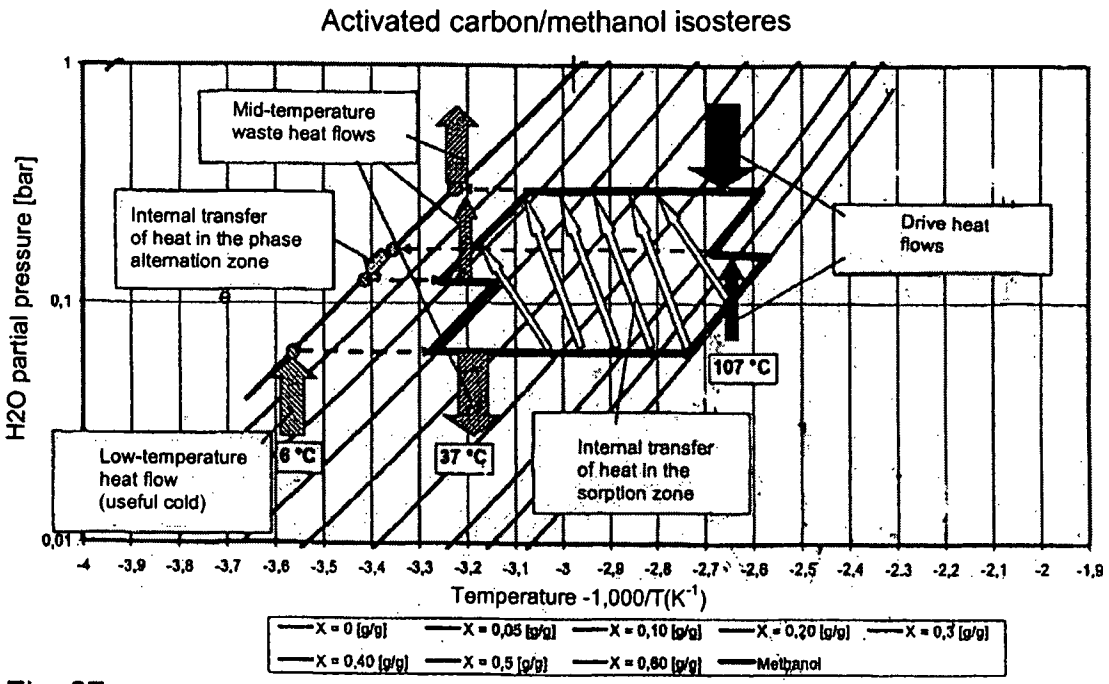
FIG. 27 is an idealized program diagram of a heat pump from FIG. 25 and FIG. 26.

A further embodiment of a heat pump, which is optimized in particular with regard to the flow paths of the second fluid, is illustrated schematically in FIG. 25 to FIG. 27. The distributor inserts 309*a*, 309*b* of the cylindrical distributor elements 309, 310 for distributing the second fluid have four respective chambers 311*a*, 311*b*, 311*c*, 311*d*. In this case, each two opposing chambers 311*a*, 311*c* have a similar, relatively large opening angle and the two other opposing chambers 311*b*, 311*d* have a correspondingly small opening angle. The chambers 311*b*, 311*d* with a small opening angle of the two hollow cylindrical distributing devices 309, 310 are joined together in the connection regions by means of lines 330 (see FIG. 26), thus forming overall a closed flow path between the four chambers 311*b*, 311*d* having a small opening angle. An additional conveyance pump 331 is provided in one of the lines 330 for conveying the second fluid in this flow path. The view of this arrangement according to FIG. 26 reveals that there is a certain similarity to the version from FIG. 12 in which merely individual flow paths are separated off for thermal isolation.

Figure 17:
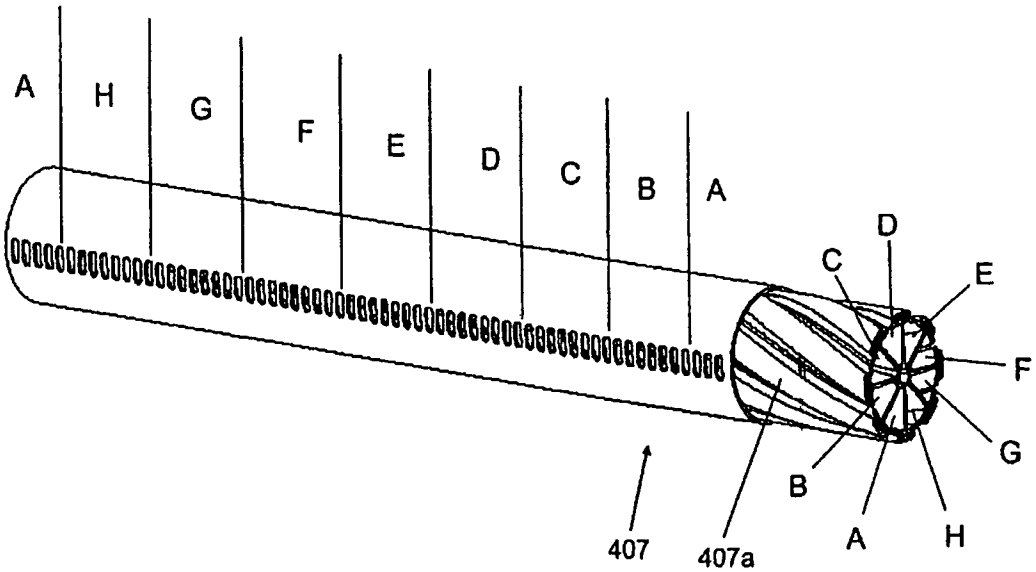
FIG. 17 is a three-dimensional view of a hollow cylinder with a distributor insert of the heat pump from FIG. 16.
Figure 19:
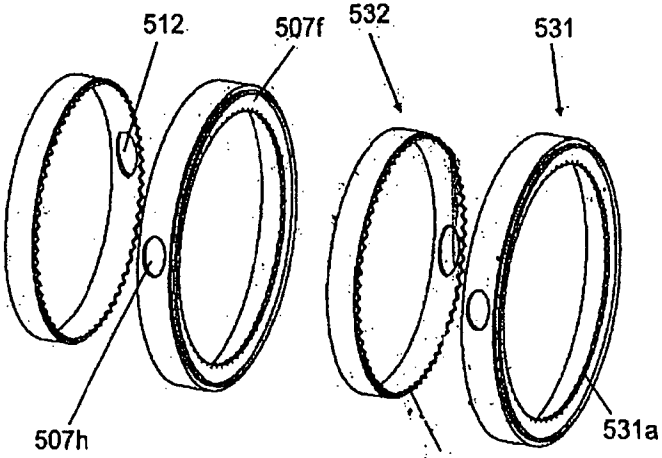
FIG. 19 is a three-dimensional exploded view of two successive annular chamber modules of the hollow cylinder from FIG. 18.
Figure 18:
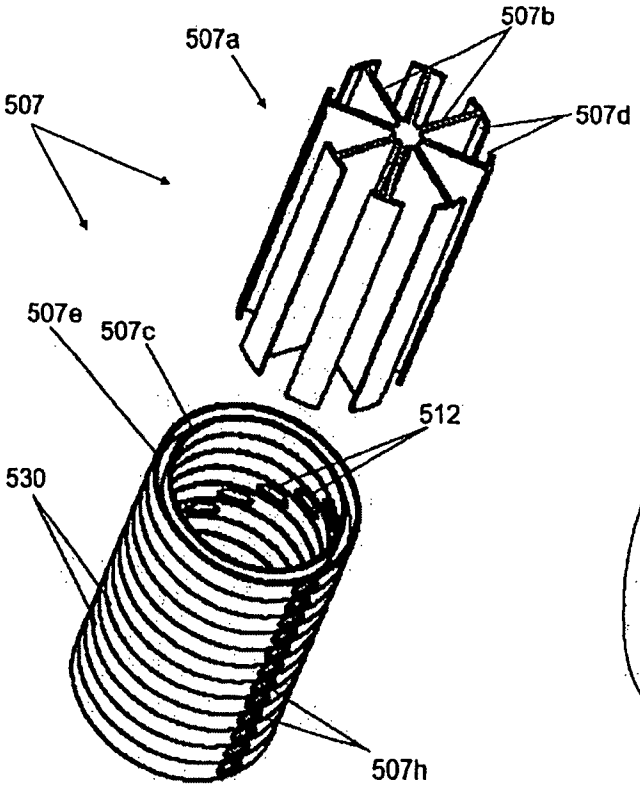
FIG. 18 is a three-dimensional view of a detail of a hollow cylinder and a distributor insert of a further exemplary embodiment of the invention.

FIG. 27 shows, in a process diagram illustrated in accordance with FIG. 10, corresponding process control such as may be achieved by a heat pump according to FIG. 25 and FIG. 26. The diagram shows a schematized and idealized cyclic process with the pair of substances, activated carbon/methanol, with in each case an additional evaporation temperature level and an additional condensation temperature level. These temperature levels are created by fluidic, and thus thermal, coupling of the last evaporation zone to a condensation zone as shown in FIG. 17. In this exemplary embodiment, a small portion of the useful fluid cooled by evaporation is used to lower the condensation temperature in the concluding phase of the regeneration process (desorption/condensation) to a much lower level. As a result of the lowering associated therewith of the steam pressure, the desorption temperature is also lowered without the load width used having to be reduced in the process. In this way, heat sources can still be used at a lower temperature level; this is advantageous, for example, if solar/thermal systems or engine-based cogeneration units are used.

In the illustrated case, according to FIG. 25 or FIG. 26, the fluid is withdrawn from a condensation stage operating at a reduced temperature level to act on the last evaporation zone. This connection brings about an internal transfer of heat from an intermediate-temperature condensation stage to a somewhat lower intermediate-temperature evaporation stage, as is indicated by the small arrow in FIG. 27 ("internal transfer of heat in the phase alternation zone"). As a result, the corners of the cyclic process which curtail the range of application (maximum desorption temperature and minimum adsorption temperature) are intensified somewhat. This measure can enlarge somewhat the operating temperature range which can be covered by a specific pair of substances without significant losses in performance figures. FIG. 27 shows additional arrows which run from the bottom right to the top left and are intended to symbolize the internal heat flux from adsorption to desorption. This heat flux is brought about by the specific connection, which can be inferred for example from FIG. 8, for the fluid control of the passage regions of the first type or of the sorption zone which is produced, even in the above-described embodiments, without the additional transfer of heat within the phase alternation zone.

Partial block A shows in a schematic view the position of the distributor inserts at the start of the low-temperature evaporation stage which serves to cool down the fluid flow used.

The associated flow paths are defined in their width in the stacking direction (see the view of FIG. 26) by the angle size of the chambers. In partial block B the distributor inserts are located in the position for the subsequent intermediate-temperature evaporation. The smaller chamber segments associated with the flow path are in flow connection with the likewise small chamber segments formed from partial block D which defines a flow region for intermediate-temperature condensation. This partial block D adjoins partial block C which defines the flow region for the high-temperature condensation. Partial block D is followed in turn by partial block A. This separate circuit or flow path is driven by the separate small circulating pump 331.

Figure 16:
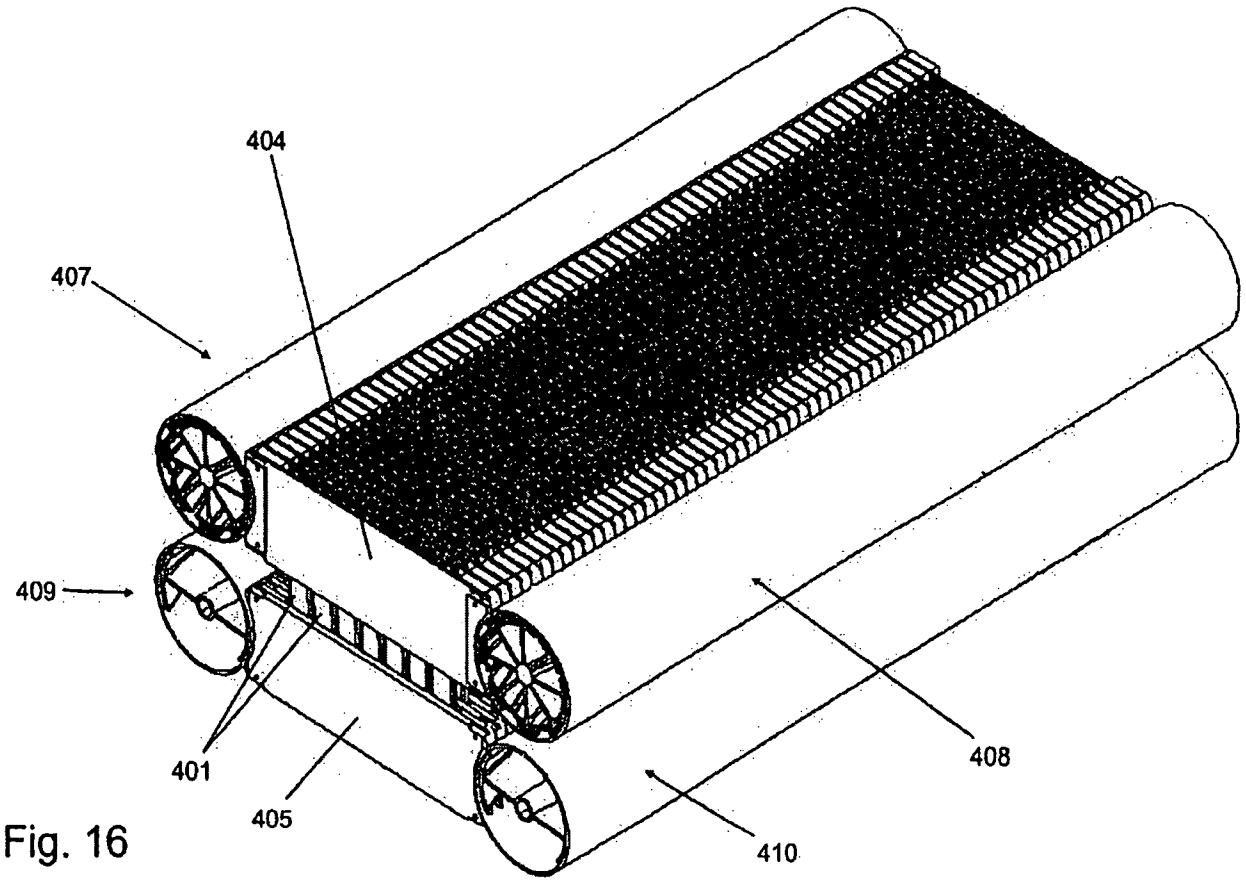
FIG. 16 is a three-dimensional view of a further embodiment of a heat pump according to the invention.

A further embodiment of the heat pump, which is in particular a design variation, is shown in FIG. 16 and FIG. 17. In contrast to the schematic constructional solution from FIG. 1, in this case the cylindrical distributing devices 407, 408, 409, 410 are formed as modules which have a cylindrical outer wall and are arranged at their ends outside the hollow plates 404, 405. The distributing devices are in this case shown without the connection regions.

As, in particular, the construction of a cylinder 407 according to the view of FIG. 17 shows, there are in the schematic embodiment according to FIG. 5 in each case eight separate chambers A-H of the same opening angle, corresponding to eight adjacent flow paths of the same width through the stack of hollow elements.

A further exemplary embodiment is shown in FIG. 18 to FIG. 24, thus providing a particularly suitable constructional solution. As in the other described exemplary embodiments, the distributing devices 507, 508 are formed as a hollow cylinder with a rotatable distributor insert 507*a*. In contrast to the above-described exemplary embodiments, the distributor insert 507*a* has however partitions 507*b* with lugs 507*d* which run straight in the axial direction (or stacking direction) and are not spirally curved. This allows the distributor inserts 507*a* to be manufactured particularly cost-effectively and simply.

To achieve a corresponding distribution of the fluid to the flow paths which migrate in the stacking direction on rotation of the distributor inserts, the cylindrical wall 507*c* surrounding the distributor inserts 507*a* has a plurality of apertures 512 which succeed one another in the axial direction and are each arranged offset from one another by a small angle and thus lie on a spiral line along the cylinder wall. Over the entire axial length of the cylinder wall 507*c*, the spiral line describes one or more, expediently complete revolutions.

The cylindrical wall 507*c* is surrounded by an outer cylinder wall 507*e*, radial partitions 507*f* between the inner wall 507*c* and outer wall 507*e* separating off an annular chamber 507*g* at each of the apertures 512.

In the outer wall 507*e*, connection openings 507*h*, which provide a connection to the passage regions of the heat pump, are respectively provided in alignment on a straight line, for each of the annular chambers, without an angular offset.

Specifically, the individual constructionally identical annular chamber modules 530 are each composed of an outer ring 531 and an inner ring 532, the outer ring 532 having a radial chamfer to form the partition 507*f* between adjacent annular chamber modules 530. In the present case, the inner rings 532 and the outer rings 531 have corresponding teeth 531*a*, 532*a* which engage with one another during assembly to set a defined angular offset of the apertures 512. In particular in the case of automated production, such teeth may be dispensed with. The annular chamber modules 530 can be made of one or more suitable materials such as, for example, plastics material or else aluminum.

In order further to simplify manufacture, the outer rings 531 of the two opposing distributing devices 507, 508 can be manufactured at the same time with at least a portion of the passage regions 504 connecting them, in particular by cold extrusion. The flat tube-like passage regions 504 between the rings 531 can also be completed by suitable surface area-enlarging turbulence metal sheets or by metal cover sheets to be soldered on.

Figure 24:
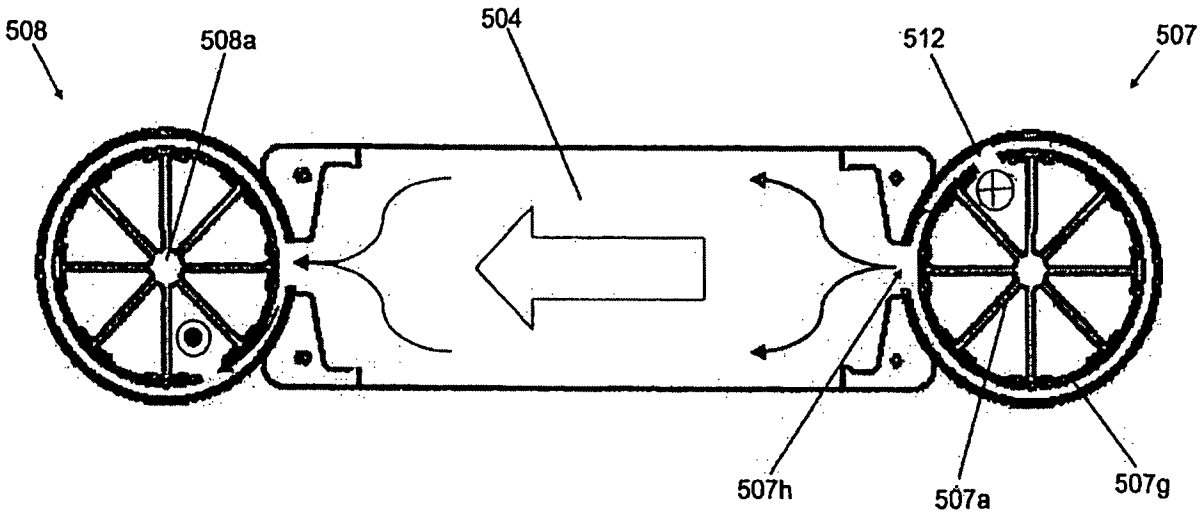
FIG. 24 is a schematic sectional view through a part of a heat pump with the distributing device according to FIG. 18 to FIG. 23.

FIG. 24 is a schematic sectional view through the passage regions of the second type of the heat pump. The second fluid flows, starting from a chamber of the axially straight distributor insert 507*a*, through one or more spirally arranged apertures 512, corresponding thereto, in the inner wall 507*c* and the annular chambers 507*g* connected to these apertures/openings 512. Subsequently, the fluid flows through the openings 507*h* in the outer wall 507*e* and through the passage regions 504 of the first type (or else the second type). After flowing through the passage regions 504 and a corresponding exchange of heat, the fluid re-enters the opposing, symmetrically constructed distributing device 508. As may be seen, the function of the distribution of the fluid to a plurality of flow paths, which additionally migrate on rotation of the distributor inserts 507*a*, is entirely analogous to the function of a distributor insert with spirally curved partitions.

The invention claimed is:

1. A heat pump comprising a number of hollow elements with a first zone, a second zone and a working medium which can be displaced in a reversible manner between the first and second zone, an equilibrium of an interaction of the working medium with each of the zones depending on thermodynamic state variables, a number of plate elements which are arranged in the form of a stack and each comprise at least one hollow element with a first and second zone, a number of passage regions of a first type arranged between the plate elements to be flowed through by a first fluid for exchanging heat with the first zone, a number of passage regions of a second type arranged between the plate elements to be flowed through by a second fluid for exchanging heat with the second zones, the first fluid and the second fluid being separated from each other, and at least two distributing devices which are arranged at the end of the plate elements in each case and associated with at least a distribution of the first fluid through the passage regions of the first type and each have a stationary hollow cylinder and a distributor insert which is able to rotate in the hollow cylinder, wherein the distributor insert has partitions which separate off in each of the cylinders at least four, preferably at least six and particularly preferably at least eight separate chambers, a flow path comprising at least one passage region being defined by each of the chambers.

2. The heat pump as claimed in claim 1, wherein the heat pump is an adsorption heat pump, the working medium being adsorbable and desorbable in the first zone and vaporable and condensable in the second zone.

3. The heat pump as claimed in claim 1, wherein the working medium is reversibly chemisorbable at least in the first zone.

4. The heat pump as claimed in claim 1, wherein the flow paths include a first group of at least two adjacent flow paths and a second group of at least two adjacent flow paths, the flow paths of the first group all being flowed through in a first direction and the flow paths of the second group all being flowed through in a direction opposite thereto.

5. The heat pump as claimed in claim 1, wherein the plate element comprises a number of parallel flat tubes, each of the flat tubes forming a hollow element with a first and second zone.

6. The heat pump as claimed in claim 5, wherein the flat tubes are hermetically separated from one another.

7. The heat pump as claimed in claim 1, wherein a hollow plate, the cavity of which is associated with one of the passage regions, is arranged between two of the plate elements, the hollow plate being thermally connected in a planar manner to the adjacent plate elements, in particular connected by soldering, adhesion or bracing.

8. The heat pump as claimed in claim 7, wherein arranged between two plate elements are a hollow plate of a first type, forming a passage region of a first type, and a hollow plate of a second type which is substantially thermally separated from the hollow plate of the first type and forms a passage region of a second type.

9. The heat pump as claimed in claim 8, wherein the hollow plates of the first and second type are of differing thickness, wherein, in particular, one type of hollow plate is designed for a liquid fluid and the other type of hollow plate for a gaseous fluid.

10. The heat pump as claimed in claim 1, wherein at least two distributing devices which are arranged at the end of the plate elements in each case and associated with a distribution of the second fluid through the passage regions of the second type are each provided with a stationary hollow cylinder and a distributor insert which is able to rotate in the hollow cylinder.

11. The heat pump as claimed in claim 10, wherein the distributor insert of the device for distributing the second fluid has spirally formed partitions which, in particular, separate off at least three separate, helical chambers in at least one of the cylinders, a flow path comprising at least one passage region of the second type being defined by each of the chambers.

12. The heat pump as claimed in claim 1, wherein at the spirally formed partitions have lugs by means of which at least one flow path can be temporarily closed.

13. The heat pump as claimed in claim 1, wherein the distributor insert has a connection region with radial apertures, a fluid exchange of the chamber being carried out via the aperture which is aligned in each case with a chamber.

14. The heat pump as claimed in claim 13, wherein the fluid exchange of a plurality of the chambers is carried out via a corresponding number of the apertures in a multipart connection space which at least partly surrounds the cylinder.

15. The heat pump as claimed in claim 14, wherein a space of the first cylinder connected to a connection space of the second cylinder is connected via a number of channels which are separated from one another.

16. The heat pump as claimed in claim 1, wherein each of the distributor inserts is able to rotate such that it can be driven in synchronization with the other distributor inserts.

17. The heat pump as claimed in claim 16, wherein a device for distributing the second fluid can be altered relative to a device for distributing the first fluid such that it can be adjusted with respect to a phase position of a distribution cycle.

18. The heat pump as claimed in claim 1, wherein an inclination of at least one coiled chamber is not constant over the length of the cylinder.

19. The heat pump as claimed in claim 1, wherein a plurality of hollow elements which are hermetically separated from one another are provided, at least two of the hollow elements having differing working media.

20. The heat pump as claimed in claim 1, wherein, at least in a plurality of cases, the flow paths of the first fluid are directed in the opposite direction to adjacent flow paths of the second fluid.

21. The heat pump as claimed in claim 1, wherein the partitions of the distributor insert are spirally formed and in that the separated-off chambers are helical.

22. The heat pump as claimed in claim 1, wherein the partitions of the distributor insert run substantially straight over the length of the distributor insert.

23. The heat pump as claimed in claim 22, wherein the hollow cylinder has a plurality of apertures, apertures which succeed one another in the axial direction each being arranged offset from one another by an angle.

24. The heat pump as claimed in claim 22, wherein the hollow cylinder surrounding the distributor inserts has an inner wall and an outer wall, a plurality of annular chambers arranged in axial succession being formed between the two walls.

25. The heat pump as claimed in claim 24, wherein the annular chambers are formed as annular chamber modules which can be stacked in the axial direction.

26. The heat pump as claimed in claim 1, wherein a means is provided for distributing the second fluid, the second fluid being guided by means of the distributing device via a plurality of flow paths through the passage regions of the second type.

27. The heat pump as claimed in claim 26, wherein one of the flow paths forms a closed loop which is separated from the remaining flow paths of the second fluid.

28. The heat pump as claimed in claim 27, wherein the closed flow path has a smaller width in the stacking direction than an adjacent flow path, the closed flow path being guided, in particular, for intermediate-temperature evaporation and/or intermediate-temperature condensation.

29. The heat pump as claimed in claim 27, wherein the closed flow path comprises a pump member for conveying the fluid.

30. A heat pump comprising a number of hollow elements with a first zone, a second zone and a working medium which can be displaced in a reversible manner between the first and second zone, an equilibrium of an interaction of the working medium with each of the zones depending on thermodynamic state variables, a number of plate elements which are arranged in the form of a stack and each comprise at least one hollow element with a first and second zone, a number of passage regions of a first type arranged between the plate elements to be flowed through by a first fluid for exchanging heat with the first zone, a number of passage regions of a second type arranged between the plate elements to be flowed through by a second fluid for exchanging heat with the second zones, the first fluid and the second fluid being separated from each other, and at least two distributing devices which are arranged at the end of the plate elements in each case and associated with at least a distribution of the first fluid through the passage regions of the first type and each have a stationary hollow cylinder and a distributor insert which is able to rotate in the hollow cylinder, wherein the distributor insert has spirally formed partitions which separate off in each of the cylinders at least four, preferably at least six and particularly preferably at least eight separate helical chambers, a flow path comprising at least one passage region being defined by each of the chambers.

31. The heat pump as claimed in claim 30, further comprising the features of claim 2.

* * * * *